United States Patent [19]

Mikkelsen

[11] Patent Number: 4,635,816

[45] Date of Patent: Jan. 13, 1987

[54] VENDING MACHINE DELIVERING CUPS CONTAINING FRESHLY MADE BEVERAGES

[75] Inventor: Per W. Mikkelsen, Odense SV, Denmark

[73] Assignee: Wittenborgs Automatfabriker A/S, Odense C, Denmark

[21] Appl. No.: 753,651

[22] Filed: Jul. 10, 1985

[30] Foreign Application Priority Data

Aug. 3, 1984 [DK] Denmark ..... 3777/84

[51] Int. Cl.[4] ..... G07F 11/12

[52] U.S. Cl. ..... 221/11; 221/105; 221/129; 221/227

[58] Field of Search ..... 221/11, 104, 105, 124, 221/129, 132, 133, 221, 222, 223, 224, 227, 244, 258

[56] References Cited

U.S. PATENT DOCUMENTS

| | | | |
|---|---|---|---|
| 2,352,858 | 7/1944 | Nicholson | 221/11 |
| 2,732,098 | 1/1956 | Lime et al. | 221/104 X |
| 3,075,480 | 1/1963 | Berg | 221/11 X |
| 3,279,652 | 10/1966 | Willvonseder | 221/223 |
| 3,506,156 | 4/1970 | Hanson et al. | 221/11 |
| 3,648,889 | 3/1972 | Greaves et al. | 221/11 |
| 3,722,741 | 3/1973 | Mojden | 221/11 |
| 3,927,799 | 12/1975 | Tindley | 221/223 |
| 4,480,764 | 11/1984 | Takagi et al. | 221/11 |

FOREIGN PATENT DOCUMENTS

| | | |
|---|---|---|
| 0087141 | 8/1983 | European Pat. Off. . |
| 1604306 | 12/1981 | United Kingdom . |

*Primary Examiner*—Joseph J. Rolla
*Assistant Examiner*—Edward S. Ammeen
*Attorney, Agent, or Firm*—Ladas & Parry

[57] ABSTRACT

A vending machine dispensing cups containing freshly made beverages comprises inter alia a cup dispenser delivering the cups one by one to a filling device. The cup dispenser includes a magazine for several succeeding rows of stacks of cups situated on a bottom. This bottom is shaped with a delivery opening allowing the front stack of cups to fall downwards by gravity upon an advancing in the magazine so as to position on a delivery mechanism present below the delivery opening. At activation this delivery mechanism is adapted to remove the lowermost cup in the stack and to deliver the cup to the filling device. The cup dispenser comprises furthermore a sensor detecting that the uppermost cup in the stack present in the delivery opening is positioned below the bottom of the magazine, the sensor furthermore activating a driving means to advance the row of stacks in the magazine. Furthermore the sensor allows the following stack to fall through the delivery opening. In order to obtain a particularly compact cup dispenser and at the same time a vending machine allowing delivery of two different cup sizes while maintaining the above compact cup dispenser, the cup dispenser comprises two magazines for their respective row of cup stacks and each with a driving mechanism and a delivery opening with a delivery mechanism. These two magazines are shaped in such a manner that the associated chambers for the rows of stacks extend coaxially and comprise delivery openings positioned immediately adjacent one another.

5 Claims, 6 Drawing Figures

VENDING MACHINE DELIVERING CUPS CONTAINING FRESHLY MADE BEVERAGES

FIELD OF THE INVENTION

The invention relates to a vending machine for cups containing freshly made beverages and comprising a cup dispenser delivering the cups one by one to a filling device, where the cup dispenser includes a magazine for rows of several succeeding stacks of cups situated on a bottom shaped with a delivery opening, said delivery opening allowing the front stack of cups to fall downwards by gravity upon an advancing in the magazine so as to position on top of a delivery mechanism which is placed below the delivery opening and which upon activation is adapted to remove the lowermost cup from the stack and to deliver said cup to the filling device, and where the cup dispenser comprises a sensor detecting that the uppermost cup of the front stack positioned on top of the delivery mechanism is flushing with or situated below the bottom of the magazine, said sensor furthermore activating a driving means advancing the row of stacks in the magazine and allowing the suceeding stack to fall through the delivery opening.

BACKGROUND ART

Vending machines delivering cups containing freshly made beverages are known where the cup dispenser comprises a container with several rows of cup stacks gradually being advanced ot a delivery mechanism. The possibility of delivering two different cup sizes according to request in the same vending machine requires relatively much room within the vending machne. It could for instance be an advantage to construct the vending machine so as to deliver cold beverages in a large cup and hot beverages in a smaller cup.

SUMMARY OF THE INVENTION

The vending machine according to the invention is characterized in that the cup dispenser comprises two magazines for their respective row of stacks of cups and each including a driving means and a delivery opening with a delivery mechanism, and that the two magazines are shaped in such a manner that the associated chambers for the rows of stacks extend coaxially and include delivery openings positioned immediately ajacent one another.

In this manner there is provided a vending machine with a cup dispenser which is relatively compact and nevertheless allows storing of two different cup sizes in their respective magazine. This is especially due to the coaxial positioning of the chambers for the rows of stacks and the close positioning of the delivery openings.

According to the invention the magazines may suitably comprise a common bottom in the form of a bottom plate, and the chambers for the rows of cups may extend between the same coaxially positioned, cylindrical wall surfaces, whereby a particularly compact cup dispenser is obtained.

Furthermore according to the invention the driving means of each magazine may advantageously comprise a pushing arm projecting radially in the space between the cylindrical wall surfaces and being pivotably mounted about the common central axis of the two cylindrical wall surfaces, said pushing arms being driven about said central axis by means of a driving motor associated with each pusher arm.

In addition according to the invention each driving motor may be connected to its associated pushing arm by means of a releasable coupling means which is adapted to engage the driving motor in any position of the pushing arm seen in a direction about its axis of rotation. As a result the two magazines present in the same cup dispenser and together having a substantially annular shape can be adjusted as to capacity in such a manner that the capacity of one magazine can be increased to the disregard of the capacity of the second magazine merely by decoupling the associated pushing arms and recoupling said arms on the desired location about their common axis.

According to the invention the inner cylindrical wall surface may be formed by two cylindrical wall surface portions positioned in extension of one another and permanently connected to their respective pushing arm and consequently pivotably mounted about their common central axis, the the outer cylindrical wall surface may be permanently mounted inside the vending machine, whereby a particularly simple embodiment is obtained.

Furthermore according to the invention the outer cylindrical wall surface may comprise a vertical slot allowing a positioning of additional stacks of cups in the magazine, and also the bottom plate may be pivotably mounted about the common axis of the cylindrical surfaces, and each magazine may comprise decoupling means adapted to disengage the coupling means from the driving motor and to retain the pushing arm in the decoupled position while the magazine in question is removed by turning the bottom plate away from the vertical slot of the outer cylindrical wall surface and in the same direction as the rows of cup stacks of the magazine in question are advanced during the use. In this manner a vending machine is provided the cup dispenser of which is easy to fill with new stacks of cups merely by turning, e.g. manually, the bottom plate as a turning of the bottom plate away from the slot in question allows the positioning of new stacks of cups through the slot of the outer cylindrical wall surface in front of the retained decoupled pushing arm. In this manner initially inserted stacks are used first too and are thereby prevented from being stored in the vending maching for too long.

According to the invention the slot in the outer cylindrical wall surface may be situated substantially in the middle between the two delivery openings when the cup dispenser is used, and the bottom plate may comprise a fixedly mounted slot closing means extending vertically and situated between the delivery openings and covering the slot when the cup dispenser is used. In this manner the interior of the magazine is protected for instance against smudging in a simple manner when the cup dispenser is used.

Each magazine may according to the invention be provided with a stack separating means, which automatically advances the leading stack to the delivery opening when half the leading stack has passed thereby, and which simultaneously provides a distance to the next stack when the driving means in question has advanced the row of stacks forward in immediate vicinity of the delivery opening. As a result it is particularly ensured that the front stack of cups can fall freely downwards through the delivery opening so as to engage the delivery mechanism.

According to the invention the stack separating means may be formed by a flap associated with each magazine and hingedly mounted about a shaft extending parallel to the axis of rotation of the pushing arm within and immediately adjacent the outer cylindrical wall surface, said flaps being biased by means of a spring towards the middle of the paths of the stack rows and extending from their axes of rotation towards the delivery openings, whereby the biasing is of such a strength that the flaps easily allow a passage of every leading stack of cups during the advancing. In this manner particulary simple stack separating means are obtained.

Finally according to the invention the stack separating means may be mounted by means of a pin shaped at each end in vertical direction and received in a hole in the bottom plate and a hole shaped in a projecting part of the slot closing means, respectively, whereby a particularly simple mounting of the stack separating means is ensured.

BRIEF DESCRIPTION OF THE DRAWING

The invention will be described below with reference to the accompanying drawing, in which.

DESCRIPTION OF PREFERRED EMBODIMENTS

Figure 1:
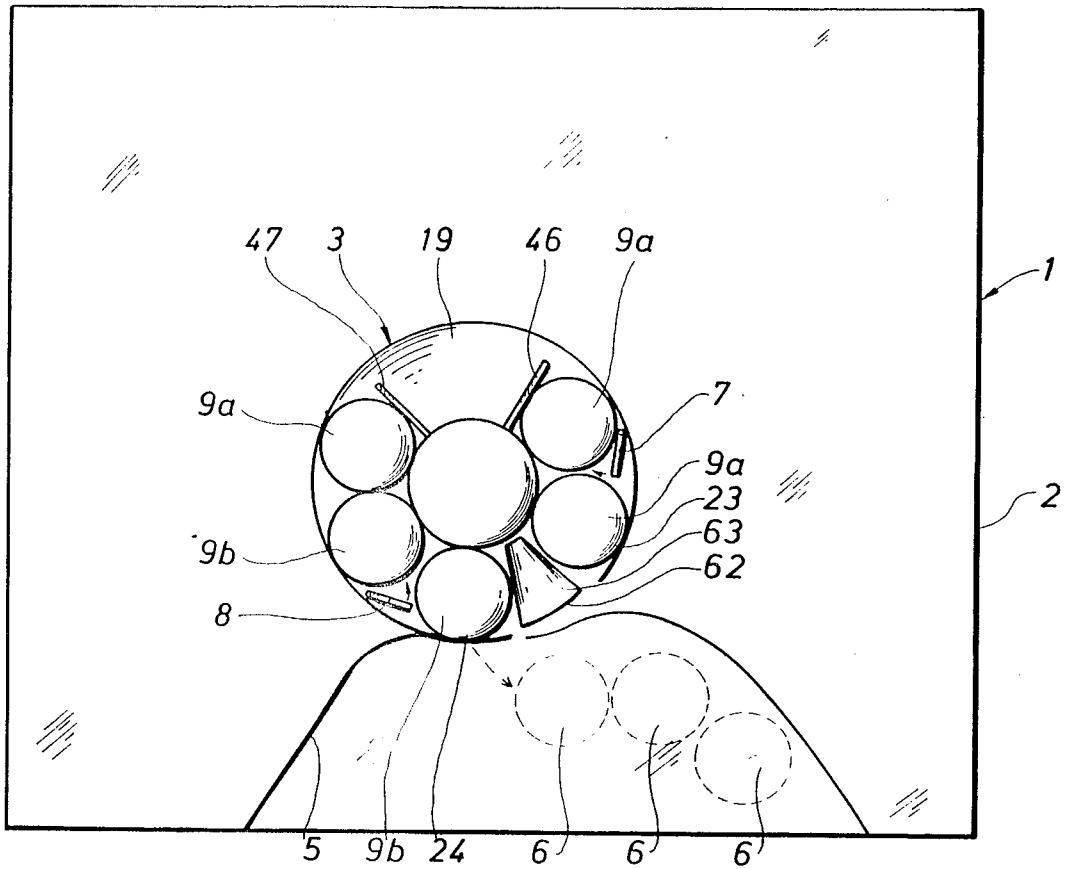
FIG. 1 is a diagrammatic, sectional top view through a vending machine delivery completed beverages in cups, whereby only parts appear for the sake of clarity.

The vending machine of FIG. 1 is provided with the general reference numeral 1. In the preferred embodiment the vending machine is formed as a cupboard-shaped cabinet 2. A cup dispenser provided with the general reference numeral 3 is situated in the above cabinet. When the vending machine is activated cups are delivered one by one to a filling device 4 ensuring in a manner known per se a filling of the cup with a desired beverage followed by a dispensing of the cup through an opening 5 on the front of the vending machine. Filled cups 6 are indicated by dotted lines in FIG. 1.

The illustrated vending machine is of the type described in Danish patent application No. 4383/81, but may be of another type using a cup dispenser for the delivery of cups one by one to the filling device. The remaining parts associated with the vending machine such as a powder- and water dispensing station and a cover delivering device are not illustrated for the sake of clarity.

As indicated in FIG. 1 and as will be described more detailed below the cup dispenser 3 comprises two magazines 7 and 8 each including a row of stacks 9*a* and 9*b* of cups. These cups are delivered one by one through the delivery mechanisms 10 and 11, respectively, cf. FIG. 2, to a filling chamber 12 in a drum 13 associated with the filling device 4. The delivery mechanisms 10 and 11 are of a generally known type such as the one disclosed by U.S. Pat. No. 3,279,652, and are adapted upon activation to remove the lowermost cup in a stack of cups and to let said cup fall downwards by way of gravity for further handling.

Figure 2:
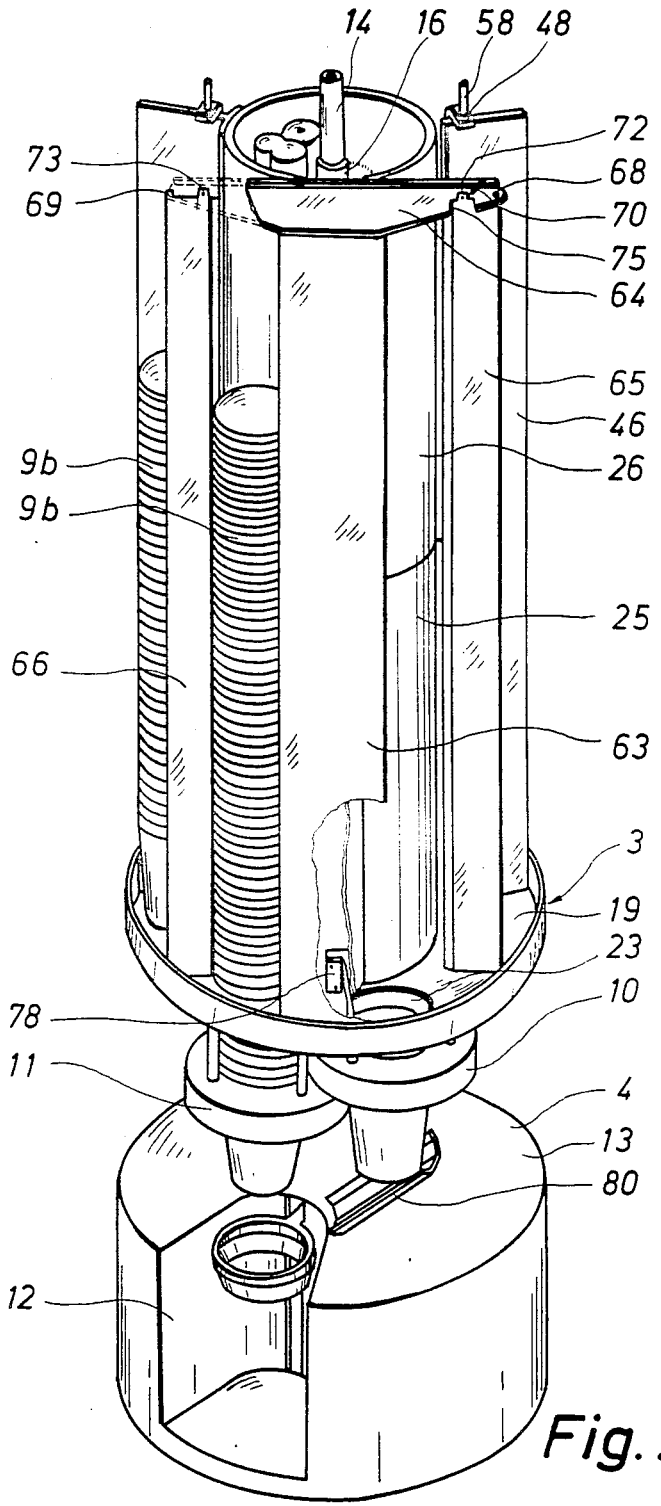
FIG. 2 is a perspective view of the cup dispenser and filling drum of the vending machine of FIG. 1, whereby parts have been removed for the sake of clarity.
Figure 3:
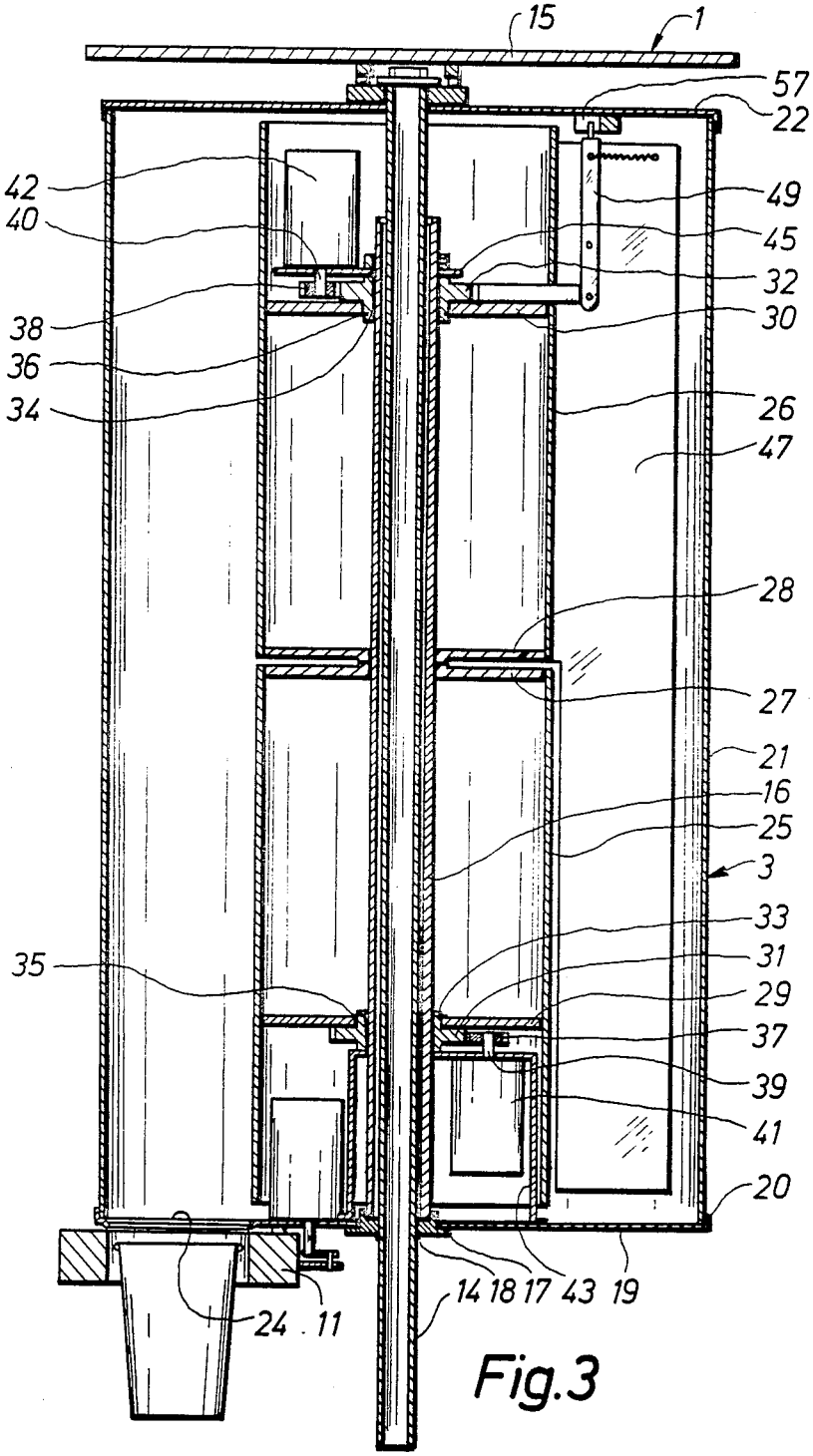
FIG. 3 is a vertical sectional view through the cup dispenser in a radial plane extending through the middle of a delivery opening.

As illustrated in FIGS. 2 and 3, the cup dispenser 3 comprises a fixed shaft 14 vertically mounted within the vending machine and secured at the upper end to the ceiling 15 of the vending machine, cf. FIG. 3. This fixed shaft is tubular and carries a rotatable sleeve 16, which at the bottom is secured to a circumferential ring 17 resting on a locking ring 18. The circumferential ring 17 and the rotatable sleeve are interconnected through welding or through interference fit. The circumferential ring 17 carries furthermore a fixed circular bottom plate 19 forming the bottom of the cup dispenser 3. Along the outer periphery this bottom plate comprises a circumferential flange 20 projecting upwards and overlapping the bottom end of an outer cylindrical wall surface 21 extending coaxially with the fixed shaft 14 and the rotatable sleeve 16. At the top the outer cylindrical wall surface 21 is secured to a top plate 22 fixedly connected to the fixed shaft 14 and consequently to the ceiling 15 of the cabinet. The circumferential flange 20 of the bottom plate 19 is spaced from the outer wall surface 21 in such a manner that the bottom plate can rotate freely relative to the outer wall surface.

Figure 4:
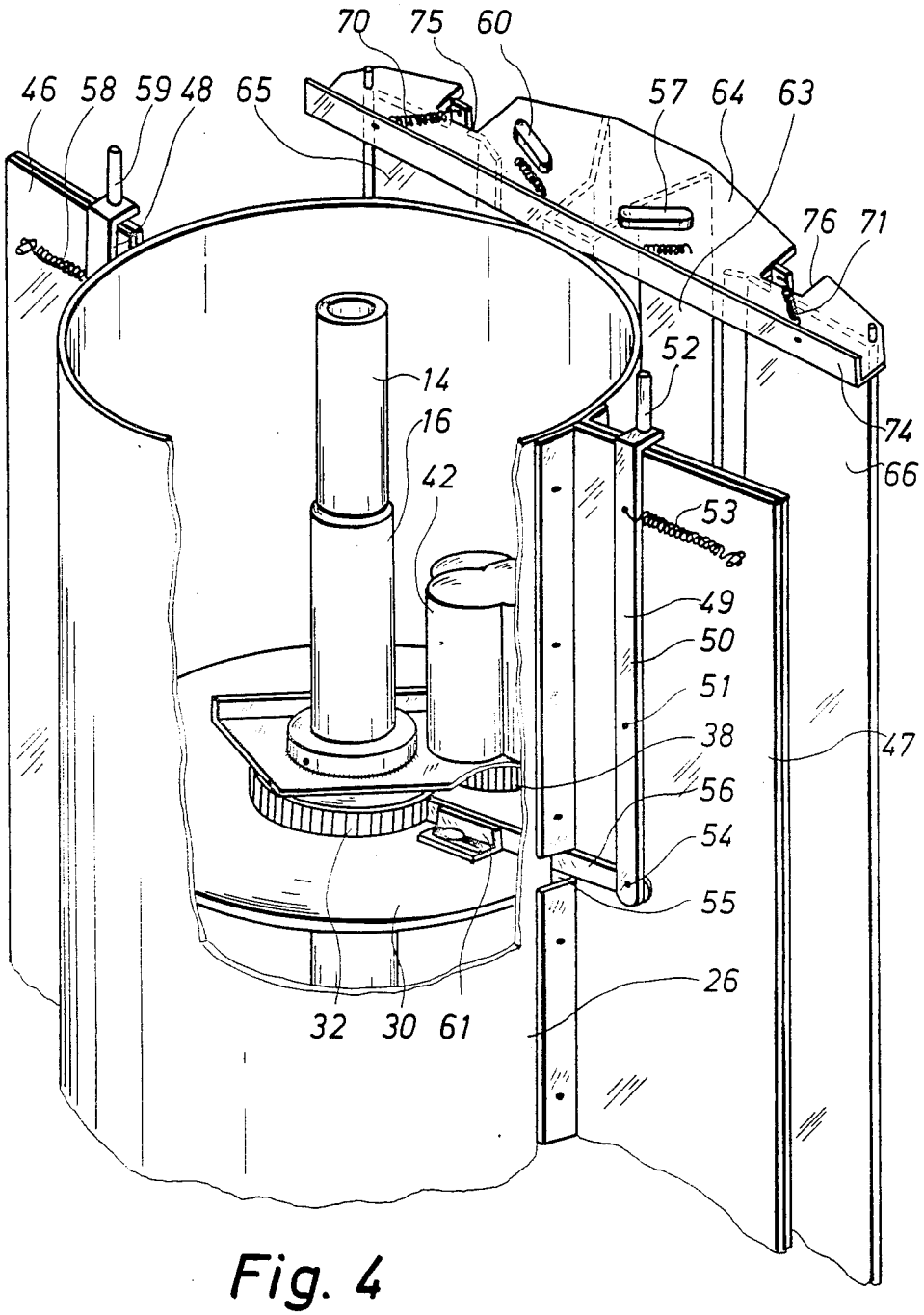
FIG. 4 illustrates the upper portion of interior parts of the cup dispenser, whereby parts have been removed for the sake of clarity.
Figure 5:
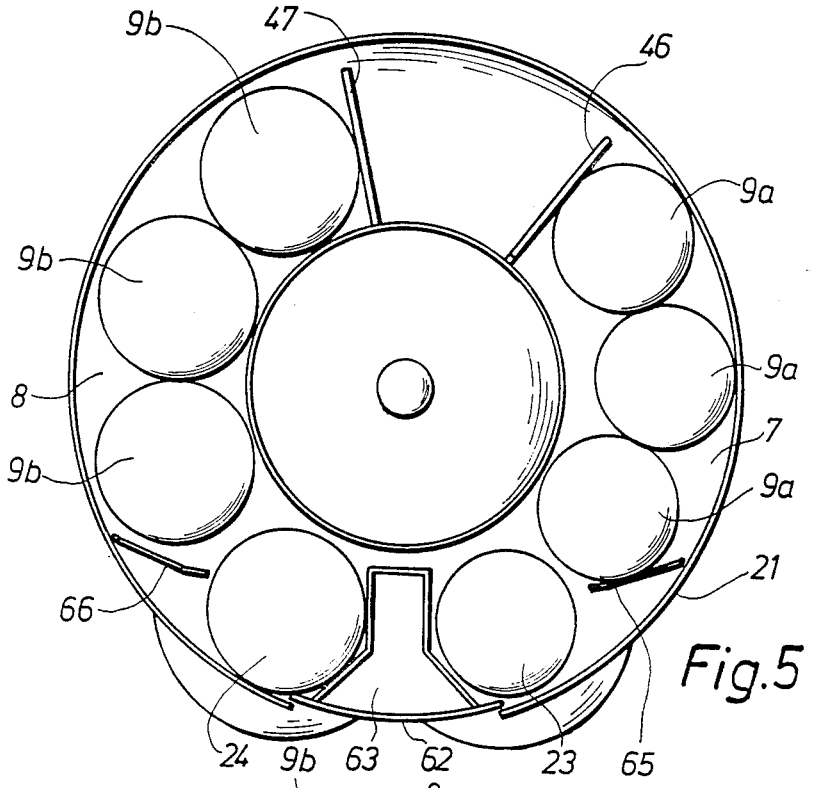
FIGS. 5 and 6 are diagrammatic, horizonital sectional views through the cup dispenser in use and during the filling of one magazine, respectively.
Figure 6:
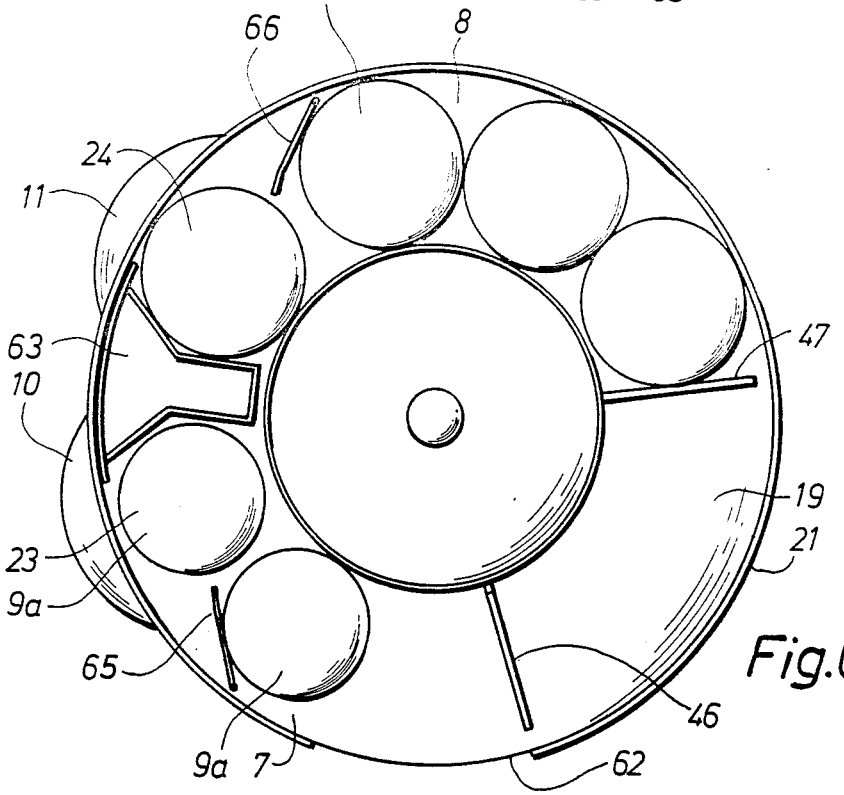

The bottom plate 19 comprises two closely situated delivery openings 23 and 24, only one appearing from FIGS. 2 and 4, but in FIGS. 1 and 5 and 6 both openings are indicated. These delivery openings 23 and 24 are situated at the front end of their respectively magazine. The above delivery mechanisms 10 and 11 are each mounted coaxially with a delivery opening 23 and 24, and on the bottom side of the bottom plate 19 in a generally known manner.

Two inner cylindrical wall surface portions 25 and 26, cf. FIGS. 2 and 3, are pivotably mounted above and coaxially with the bottom plate 19, said portions being positioned on top of one another. These cylindrical wall surface portions 25 and 26 are pivotably mounted about the rotatable sleeve 16 in a manner described more detailed below. The two inner cylindrical wall surface portions 25 and 26 are furthermore slidably abutting one another by abutting radial end surfaces 27 and 28, respectively, optionally by means of an intermediary disk not shown.

On the inner side each cylindrical wall surface portion 25 and 26 comprises a fixed hub plate 29 and 30, respectively, projecting inwards and pivotably mounted on axially projecting portions each associated a gear 31 and 32, respectively. These gears are pivotably mounted in a coaxial manner about the roatable sleeve, preferably through a suitable fit. The said axially projecting portions on the gears 31 and 32 are indicated by the reference numerals 33 and 34 in FIG. 3, and as illustrated in FIG. 3 the gears 31 and 32 and the hub plates 29 and 30 of the inner cylindrical wall surface portions are retained in axial direction relative to one another by means of locking rings 35 and 36, respectively. The two gears 31 and 32 engage a driving gear 37 and 38, respectively permanently, the latter gears being fixedly situated on the output shaft 39 and 40, respectively, from their respective motor 41 and 42. The motor 41 is secured to the bottom plate 19 and the rotatable sleeve 16 by means of supporting bracket 43, whereas the motor 42 is secured to the rotatable sleeve 16 by means of a bracket plate 45 secured on the rotatable sleeve.

As illustrated in FIGS. 2, 3, and 4 the two inner cylindrical wall surface portions are fixedly connected to their respective radially projecting pushing arm 46 and 47. These pushing arms are shaped as a plate projecting in the space between said inner cylindrical wall surface portions 25 and 26 and the outer wall surface 21 and extending substantially in the length of the entire space in axial direction without touching other wall surface portions than the one they are secured on.

As illustrated both in FIG. 3 and in FIG. 4, each pushing arm 46 and 47 comprises a coupling means 48 and 49, respectively, substantially of the same shape, for which reason only the coupling means 49 illustrated in FIGS. 3 and 4 will be described. The coupling means 49 comprises a coupling arm 5o pivotably mounted about a projecting shaft pin 51 on the wall of the pushing arm 47. This coupling arms 50 extends substantially parallel to the axis of rotation of the associated inner cylindrical wall surface and to the upper end of the pushing arm 47 where it is provided with a pin 52 projecting upwards. The end adjacent the pin 52 of the coupling arm 50 is biased by means of a spring 53 in a direction away from the associated inner cylindrical wall surface 26.

The lower end of the coupling arm 50 is at a hinge member 54 pivotably connected to a coupling rod 56 projecting substantially radially through a hole 55 in the associated cylindrical inner wall surface. The inner end of this coupling rod is adapted to cooperate with the associated driven gear 32 in such a manner that the inner cylindrical wall surface 26 in question with the associated pushing arm 47 is driven around together with the gear 32 when the coupling rod 56 engages the gear 32, whereas the pushing arm 47 and the associated inner wall surface 26 can be turned freely relative to the gear 32 and consequently also relative to the rotatable sleeve 16 when the coupling rod 56 is not engaging the driving gear 32. Thus the coupling rod 56 is adapted to disengage the driving gear 32 when the pin 52 projecting upwards of the coupling means 49 is pressed inwards against the axis of rotation of the rotatable sleeve 16. This pressing inwards movement can be performed by the cooperation of the pin 52 with a guide 57, cf. FIGS. 3 and 4, fixed on the top plate 22 of the dispenser as will be described more detailed below. When the pin 52 is not engaging the guide 57, the spring 53 ensures that the coupling rod 56 automatically engages the driving gear 32 in such a manner that the pushing arm 47 and the associated cylindrical wall surface 26 follow the turning of the gear 32 when said gear is rotated by means of the motor 42.

The coupling means 48 associated with the second pushing arm 46 comprises correspondingly a biasing spring 58 and a pin 59 projecting upwards as well as guide 60 cooperating with the pin 59. The guide 60 is also fixed on the top plate 22 of the cup dispenser and is indicated in FIG. 4 like the guide 57.

The thus movable coupling rod 56 can be guided by a guideway 61 during its movement, cf. FIG. 4.

As illustrated in FIGS. 1 and 5 and 6, the outer cylindrical wall surface 21 is provided with a longitudinal slot 62 extending in the using position downwards in the middle between the two delivery openings 23 and 24 of the bottom plate 19. This slot 62 is of such a width, seen in the circumferential direction, that a stack of cups can pass freely through said slot and into the space between the outer cylindrical wall surface 21 and the inner cylindrical wall surface portions 25 and 26, said wall surface 21 and said surface portions 25 and 26 therefore being dimensioned in such a manner that they can receive such stacks therebetween, cf. inter alia FIGS. 1, 5, and 6.

A slot closing means 63 is mounted on the bottom plate in the middle between the two delivery openings 23 and 24, said slot closing means being longitudinal, i.e. extending parallel to the common axis of the cylindrical surfaces, cf. FIG. 2. FIGS. 1, 5, and 6 are diagrammatic setional views of this slot closing means which is adapted to cover from the inside the slot 62 in the outer cylindrical wall surface 21 when the cup dispenser is used. At the upper end this slot closing means 63 carries a horizontal bracket plate 64 extending symmetrically to both sides of the slot closing means 64. At both ends this bracket plate carries a stack separating means 65 and 66, respectively, in the form of hinged flaps extending vertically between the bracket plate 64 and the bottom plate. In each end the stack separating means comprises a pin received in a hole in the bottom plate and the bracket plate, respectively, immediately adjacent the outer cylindrical wall surface 21. FIGS. 2 and 4 illustrate the upper pins provided with the reference numerals 68 and 69, respectively, of the stack separating means 65 and 66, said pins engaging a corresponding hole in the bracket plate 64. Thus the stack separating means are pivotably mounted about the pins and consequently about a vertical axis immediately adjacent the outer cylindrical wall. Individually the stack separating means 65 and 66 extend inwards towards the middle of the space between the outer cylindrical surface 21 and the inner cylindrical wall surface portions 25 and 26 and at the same time forwards towards the adjacent delivery opening 23 and 24, respectively. As illustrated in FIGS. 2 and 4 the stack separating means 65 and 66 are biased into a position projecting into said space by means of their respective spring 70 and 71. These springs are secured between a projection 72 and 73, respectively, projecting upwards on the stack separating means 65 and 66 and a flange 74 projecting upwards on the bracket plate 64. As illustrated the projections 72 and 73 are adapted to abut associated stop surfaces 75 and 76, respectively, shaped in recesses in the bracket plate 64 when the stack separating means 65 and 66 are not stressed and only influenced by their biasing springs 70 and 71.

The individual parts of the cup dispenser are dimensioned in such a manner that to both sides away from the delivery openings 23 and 24 room is present for a row of stacks 9*a* and 9*b*, respectively, of cups, cf. for instance FIG. 5. The pushing arms 46 and 47 are adapted to push the stacks of cups 9*a* and 9*b*, respectively forwards towards their respective delivery opening 23 and 24. The stack separating means 65 and 66 are situated and dimensioned in such a manner that during the advancing of the stacks they allow passage of a leading stack past their free end projecting inwards. When half the leading stack has passed the stack separating means in a direction forwards towards the delivery opening in question, the stack separating means 65 and 66 and the associated biasing springs imply that the front stack in question is pushed forwards towards the delivery opening 23 and 24 in question and thereby separated from the next stack in such a manner that said first stack can fall freely downwards through the delivery opening 23 and 24 in question.

As illustrated in FIG. 2, an empty-sensor 78 for instance in the form of a microswitch is situated in connection with the delivery opening 23 and the associated delivery mechanism 10. This empty-sensor 78 is adapted to detect whether a cup is present in the delivery mechanism 10 in question over a level situated below the level of the bottom plate. A corresponding empty-sensor not shown is provided in connection with the delivery mechanism 11. These empty-sensors are connected in a manner not described more detailed to their respective motor 41 and 42, and are adapted to activate said motors to drive their associated pushing arm 46 and 47, respectively, a distance forward corresponding to the situation that a new stack 9a or 9b of cups has been advanced past a stack separating means 65 or 66 and has fallen downwards through the corresponding delivery opening 23 or 24.

The function of the cup dispenser will be described in the following whereby the filling of its two magazines 7 and 8 is described, especially with reference to FIGS. 5 and 6. When the magazine 7 is to be filled with stacks of cups, the bottom plate 19 is turned clockwise, cf. FIGS. 5 and 6 showing diagrammatic, sectional top views leaving out the top plate 22 and the bracket plate 64. The rotatable sleeve 16, the motors 41 and 42 and consequently the gears 31 and 32 engaging the output gears 37 and 38 of the motors follow the turning of the bottom plate 19. At the same time the pushing arms 46 and 47 follow the turning because the coupling means 48 and 49 engage the gears 31 and 32. Also the slot closing means 63 and the stack separating means 65 and 66 secured thereto follow the bottom plate. As illustrated in FIG. 4, the guides 57 and 60 releasing the coupling means 48 and 49 are positioned above the bracket plate 64 when the bottom plate with the slot closing means 63 is in the position in which the slot 62 in the outer cylindrical wall surface 21 is covered, i.e. the usual use position of the cup dispenser. As the bottom plate 19 is turned the bracket plate 64 is removed from the guide 60 and at a time during the turning the pin 59 of the coupling means 48 engages the guide 60 and the coupling means 48 is decoupled. As a result the pushing arm no longer follows the clockwise turning of the bottom plate 19 relative to FIGS. 5 and 6. FIG. 6 illustrates the cup dispenser in a situation in which the bottom plate is turned slightly more than 90° away from the slot 62, and here the pushing arm 46 is stopped immediately adjacent the side of the slot 62 adjacent the magazine 7 in question when the cup dispenser is used, i.e. the right side relative to FIGS. 5 and 6. During the continued turning of the bottom plate 19 room is therefore left for a succeeding positioning of stacks of cups **9*a*, a first stack of cups being positioned in the very delivery opening 23 in such a manner that the lowermost cup of the stack rests on top of the delivery mechanism 10. The next stack is positioned after the stack separating means 65, and subsequently additional stacks of cups are inserted in the desired number or in the number containable in the room until the pushing arm 47 associated with the second magazine 8 abuts the decoupled pushing arm 46. As soon as the desired number of cup stacks 9*a* is positioned in the magazine 7, the bottom plate 19 is returned to the starting position, cf. FIG. 5, and during said returning the coupling means 59 automatically disengages its associated guide 60 in such a manner that it is recoupled with the associated motor 41. The second magazine 8 is filled in a corresponding manner by turning the bottom plate counter-clockwise. As soon as the containers are filled with the desired number of cup stacks 9*a* and 9*b* and the bottom plate 19 is positioned in the starting position with the slot closing means 63 situated directly within the slot 62 in the outer cylindrical wall surface 21, the cup dispenser is ready for use. When a customer orders a beverage in the vending machine 1, the cup dispenser is activated in a generally known manner to dispense a cup from one of the delivery mechanisms 10 or 11. The containers are suitably filled with cups of different sizes, and consquently the delivery mechanism 10 or 11 including the cup type in question is activated. As illustrated in FIG. 2, the cups fall from the delivery mechanism 11 directly into the filling chamber 12 in the drum 13, whereas the cup from the delivery mechanism 10 falls into the filling chamber 12 through a chute 8o. When the empty-sensor 78 of a delivery mechanism 10 or 11 detects that the uppermost cup of a stack of cups in the delivery mechanism is positioned below the bottom plate 19, the associated motor 41 or 42 is activated so as to push a new stack of cups forwards past the stack separating means 65 or 66. Subsequently the motor is stopped again when the empty-sensor 78 detects that a new stack of cups has fallen downwards through the delivery opening 23 or 24 in question. This procedure continues until the last stack of cups has been advanced to the delivery opening 23 and 24**. The separating means is not rendered inoperative by the subsequent stack. The separating means functions like a "rachet" lever. Due, in part, regard to the circular contour of the stacks and the biasing spring associated with the separating means, and due to the stacks being free standing without any mutual connection, the leading stack is given a push of the "rachet" like lever during the movement of the "rachet" like lever into the space between the leading stack and the subsequent stack. In a manner not described more detailed the cup dispenser can be provided with a sensor detecting that the last stack of cups has been advaned to the delivery opening in such a manner that the motor in question is not activated the next time the empty-sensor detects that the stack of cups in the delivery opening is about to being used, but then emits a signal that the latter is the case in such a manner that the owner of the vending machine is automatically informed in this respect.

The cup dispenser can be manufactued of many different materials, and the outer cylindrical wall surface 21 is suitably made of a transparent material allowing a visual observation of the number of cup stacks left in the containers. The invention has furthermore been described with reference to a preferred embodiment. Many alterations can, however, be carried out without thereby deviating from the scope of the invention.

I claim:

1. A vending machine for cups containing freshly made beverages and comprising a cup dispenser delivering the cups one by one to a filling device, where the cup dispenser includes a magazine for rows of several succeeding stacks of cups situated on a bottom plate shaped with a delivery opening and driving means for advancing the stacks in the magazine, said delivery opening allowing the front stack of cups to fall downwards by gravity upon the advancing in the magazine so as to position the front stack on top of a delivery mechanism which is placed below the delivery opening and which upon activation is adapted to remove the lowermost cup from the stack and to deliver said cup to the filling device and where the cup dispenser comprises a sensor detecting that the uppermost cup of the front stack positioned on top of the delivery mechanism is flushing with or situated below the bottom plate of the magazine, said sensor furthermore activating said driving means advancing the row of stacks in the magazine and allowing the succeeding stack to fall through the delivery opening, characterized in that the cup dispenser comprises two magazines for their respective rows of stacks of cups and each including a driving means and a delivery opening with a delivery mechanism and the two magazines having associated chambers for the rows of stacks, and that the two magazines are shaped in such a manner that the associated chambers for the rows of stacks extend coaxially and include delivery openings positioned immediately adjacent one another, and wherein there are inner and outer cylindrical wall surfaces having a common central axis, the driving means of each magazine comprising a pushing arm projecting radially in the space between the cylindrical wall surfaces and being mounted about the common central axis of the two cylindrical wall surfaces, said pushing arms being driven about said central axis by means of a driving motor associated with each pusher arm, and wherein each driving motor is connected to its associated pushing arm by means of a releasable coupling means which is adapated to engage the driving motor in any position of the pushing arm seen in a direction about its axis of rotation.

2. A vending machine as claimed in claim 1, characterized in that the inner cylindrical wall surface is formed by two cylindrical wall surface portions positioned in extension of one another and permanently connected to their respective pushing arm and consequently rotatably mounted about the common central axis, and that the outer cylindrical wall surface is permanently mounted inside the vending machine (1).

3. A vending machine as claimed in claim 2, characterized in that the outer cylindrical wall surface comprises a vertical slot allowing a positioning of additional stacks of cups in the magazine, and that also the bottom plate is rotatably mounted about the common central axis of the cylindrical surfaces, and that each magazine comprises decoupling means adapted to disengage the coupling means from the driving motor and to retain the pushing arm in the decoupled position while the magazine is removed from its position by turning the bottom plate away from the vertical slot of the outer cylindrical wall surface and in the same direction as the rows of cup stacks of the magazine are advanced during the use.

4. A vending machine as claimed in claim 3, characterized in that the vertical slot in the outer cylindrical wall surface is situated substantially in the middle between the two delivery openings when the cup dispenser is used, and that the bottom plate comprises a fixedly mounted slot closing means extending vertically and situated between the delivery openings and covering the slot when the cup dispenser is used.

5. A vending machine as claimed in one of the preceding claims 1 to 4, characterized in that each magazine is provided with a stack separating means which automatically advances the leading stack to the delivery opening when half the leading stack has passed thereby, and which simultaneously provides a distance to the next stack when the driving means has advanced the row of stacks forward in immediate vicinity of the delivery opening, and wherein the stack separating means are formed by a flap associated with each magazine and hingedly mounted about a shaft extending parallel to the axis of rotation of the pushing arm within and immediately adjacent the outer cylindrical wall surface, said flaps being biased by means of a spring towards the middle of the paths of the stack rows and extending from the axes of rotation towards the delivery openings, whereby the biasing is of such a strength that the flaps easily allow a passage of every leading stack of cups during the advancing, and each stack separating means is mounted by means of a vertical pin attached at each end of said separating means and received in a hole in the bottom plate and a hole in a projecting part of a slot closing means, respectively.

* * * * *